United States Patent [19]

Itoh

[11] Patent Number: 4,667,201

[45] Date of Patent: May 19, 1987

[54] ELECTRONIC SCANNING ANTENNA

[75] Inventor: Shin-Ichi Itoh, Tokyo, Japan

[73] Assignee: NEC Corporation, Tokyo, Japan

[21] Appl. No.: 675,642

[22] Filed: Nov. 28, 1984

[30] Foreign Application Priority Data

| | | | |
|---|---|---|---|
| Nov. 29, 1983 | [JP] | Japan | 58-224834 |
| Feb. 28, 1984 | [JP] | Japan | 59-36526 |
| Aug. 24, 1984 | [JP] | Japan | 59-176226 |

[51] Int. Cl.[4] ..... H01Q 3/26

[52] U.S. Cl. ..... 342/371; 342/368

[58] Field of Search ..... 343/368, 371, 372, 374, 343/359, 367

[56] References Cited

U.S. PATENT DOCUMENTS

| | | | |
|---|---|---|---|
| 3,526,898 | 9/1970 | Plunk et al. | 343/371 |
| 3,945,007 | 3/1976 | Radford | 343/368 |
| 4,103,303 | 7/1978 | Regenos et al. | 343/368 |
| 4,178,581 | 12/1979 | Willey, Sr. | 343/368 |
| 4,446,463 | 5/1984 | Irzinski | 343/371 |

*Primary Examiner*—Theodore M. Blum
*Assistant Examiner*—D. Cain
*Attorney, Agent, or Firm*—Schwartz, Jeffery, Schwaab, Mack, Blumenthal & Evans

[57] ABSTRACT

An electronic scanning antenna which effects radiation beam scanning based on a phase electronic scanning. The antenna has a plurality of radiation aperture units and power is fed concurrently to the plurality of radiation aperture units within a range of a small elevation angle. Thus, the degradation of a beam is reduced and a narrow beam can be formed with a high efficiency. Further, the antenna is configured wherein an electric field distribution on a radiation aperture plane formed by at least one radiation aperture is set so as to correspond to an electric distribution based on a predetermined design, thereby always normally maintaining aperture efficiency and radiation characteristic of a radiation beam over a range of a predetermined scanning angle.

10 Claims, 15 Drawing Figures

ELECTRONIC SCANNING ANTENNA

BACKGROUND OF THE INVENTION

The present invention relates to an electronic scanning antenna, and more particularly to an electronic scanning antenna for scanning a pencilbeam within a range of a broad elevation angle used in a radar system. Specifically, the present invention is concerned with an improvement in aperture efficiency and radiation characteristics in an electronic scanning antenna applicable to a broad scanning angle range.

In general, electronic scanning antennas functioning to scan a radiation beam (inclusive of a single beam and a multi-beam) based on a phase electronic scanning system so as to correspond to a predetermined broad scanning angle range have been widely used in a radar system etc. In a commonly used electronic scanning antenna in which a radiation beam is scanned in a vertical plane, for instance, with a view to enlargement of a scanning angle range without markedly impairing the radiation characteristics of the radiation beam, a radiation aperture unit 1 is installed so that an elevation angle of a normal 101 of the aperture unit 1 becomes equal to $\theta_N$ with respect to a horizontal line 102 as shown in FIG. 1. For example, as shown in this figure, the radiation aperture unit 1 is set so that a radiation beam 103 is scanned over a broad elevation angle range from the horizontal line 102 to an elevation angle $\theta_S$. In general, as well known in the art, a radiation beam which is radiated from a radiation aperture unit has its radiation characteristics restricted by an electric field distribution at the radiation aperture unit. Also, to increase an aperture efficiency of the radiation aperture unit and reduce a sidelobe level to improve the radiation characteristics, the essential requirement is to set a phase distribution in the electric field distribution to a predetermined in-phase state and to set an amplitude distribution in the electric field distribution to a predetermined state. In the case shown in FIG. 1, even in the condition where an electric field distribution at the radiation aperture unit 1 is suitably set in a manner stated above, the beam width in a vertical plane of the radiating beam 103 formed in a direction of an elevation angle $\theta$ is approximately proportional to $1/\cos(\theta-\theta_N)$. Accordingly, the beam width in the horizontal direction 102 which requires the narrowest beam width in a radar system is expanded by a multiple of the order of $1/\cos\theta_N$ as compared to the beam width in the direction of the elevation angle $\theta_N$. In addition, when the elevation angle $\theta_N$ is relatively large, there is a tendency that the sidelobe level increases, resulting in such unfavorable phenomena that both reduced aperture efficiency and degraded radiation characteristics are concurrently caused. In principle, as far as detection capability of the radar system is concerned, it is strongly required to increase the aperture efficienty and improve the radiation characteristics etc., in obtaining antenna functions within a small elevation angle range about the horizontal line. Nevertheless, as the scanning angle range of a radiation beam increases, there still arises the above problem that the antenna function is degraded within a small elevation angle range about the horizontal line.

To eliminate the above-mentioned drawback, another example of an electronic scanning antenna as shown in a conceptual block diagram of FIG. 2 has been proposed wherein a radiating beam is scanned in a vertical plane similar to the electronic scanning antenna shown in FIG. 1. An antenna radiation section comprises two radiation aperture units 2 and 3 which are positioned so that normal 104 and 105 to respective radiation aperture surfaces form elevation angles of $\theta_{N1}$ and $\theta_{N2}$ with respect to a horizontal line 106. A radiation beam radiated from the radiation aperture unit 2 is scanned over an angular range of elevation angles from 0 (zero) to $\theta_{S1}$. On the other hand, a radiation beam which is radiated from the radiation aperture unit 3 is scanned over an angular range of elevation angle from $\theta_{S1}$ to $(\Theta_{S1}+\theta_{S2})$. During transmission, a transmission signal from a terminal 51 is inputted to an RF power switch 4. The RF power switch 4 effects switching operation under the control of a radiation beam control signal from a terminal 52 to feed power to either the radiation aperture unit 2 or the radiation aperture unit 3. Accordingly, the radiation beam is scanned over an angular range from elevation angles 0 (zero) to $(\theta_{S1}+\theta_{S2})$, on the basis of the radiation beam scanning function of the radiation aperture units 2 and 3 and the signal switching fucntion of the RF power switch 4. In general, the antenna configuration is in no way limited to the case where the antenna radiation section comprise only two radiation aperture units as shown in FIG. 2. For instance, the antenna radiation section may comprise a plurality of, more than two, radiation aperture units. Further, among the radiation aperture units as constituent elements of the antenna radiation section, there may exist one or more radiation aperture units without provision of a radiation beam scanning function.

In the prior art electronic scanning antenna shown in FIG. 2, the antenna radiation section is provided with two radiation aperture units 2 and 3, thereby restricting the scanning angle range for a radiation beam at each radiation aperture unit to a relatively narrow angular range. Thus, this can suppress the degradation of the aperture efficiency including broadening of a radiation beam at the time of beam scanning etc. and the degradation of the radiation characteristics, as compared to the electronic scanning antenna shown in FIG. 1.

However, in the electronic scanning antenna shown in FIG. 2, a radiation beam within a small elevation angle range about the horizontal line 106 is formed only by the radiation aperture unit 2, and the radiation aperture unit 3 does not at all contribute to the formation of this radiation beam. Accordingly, the radiation aperture units 2 and 3 which should effectively function as an antenna radiation section merely become active as a partially limited aperture within a small elevation angular where detection capability of radar sytems should be quaranteed, resulting in the drawback that the degree of the aperture efficiency is not sufficient for the antenna function.

SUMMARY OF THE INVENTION

With the above in view, an object of the present invention is to provide an electronic scanning antenna which can eliminate the above-mentioned drawbacks.

Another object of the present invention is to provide an electronic scanning antenna wherein a phase beam scanning system is employed in an electronic scanning antenna having a plurality of radiation aperture units and power is concurrently fed to the plurality of radiation aperture units in a range of a small elevation angle, thereby to reduce the degradation of a beam to be formed and form a narrow beam with a high efficiency.

Another object of the present invention is to provide an electronic scanning antenna wherein an electric field distribution on a radiation aperture formed by at least one radiation aperture unit is set so as to correspond to an electric distribution based on a predetermined design, thereby always normally maintaining aperture efficiency and radiation characteristic of a radiation beam over a range of a predetermined scanning angle.

According to one aspect of the invention, an electronic scanning antenna for scanning a radiation beam based on a phase electronic scanning within a predetermined beam scanning angular region comprises an antenna radiation section having N (integer more than one) radiation aperture units which totally form a predetermined radiation aperture of the electronic scanning antenna, the N radiation aperture units consisting of $N_1$ (zero or positive integer) radiation aperture units having a function to scan a radiation beam on the basis of a phase electronic scanning and $N_2$ ($=N-1$, zero or positive integer) radiation aperture units without the function of radiation beam scanning, said $N_1$ radiation aperture units and said $N_2$ radiation aperture units have beam forming angular regions constituting at least part of the predetermined beam scanning angular region, respectively; and means for simultaneously exciting at least two radiation aperture units to form a radiation beam in at least one direction on a predetermined beam scanning plane and for exciting a single radiation aperture unit or a combination of radiation aperture units which are different from the at least two radiation aperture units in at least one additional direction which is different from the at least one direction.

In one embodiment, the antenna further comprises a feed unit including a plurality of feed circuits for setting predetermined aperture plane electric field distributions with respect to a plurality of radiation apertures of at least one radiation aperture unit constituting said antenna radiation section, an RF power switch having output terminals connected to input terminals of plurality of feed circuits, and second RF power switches connected between output terminals of plurality of feed circuits and inputs terminals of antenna radiation section.

In another embodiment, the antenna further comprises a feed unit including a plurality of feed circuits for setting predetermined aperture plane electric field distributions with respect to a plurality of radiation apertures of at least one radiation aperture unit constituting the antenna radiation section, an RF power switch having output terminals connected to input terminals of the plurality of feed circuits, and variable power phase shifters connected between output terminals of the plurality of feed circuits and inputs terminals of the antenna radiation section.

BRIEF DESCRIPTION OF THE DRAWINGS

The features and advantages of an electronic scanning antenna according to the present invention will be more apparent from the following description taken in conjunction with the accompanying drawings, in which.

DETAILED DESCRIPTION OF THE PREFERRED EMBODIMENTS

Figure 1:
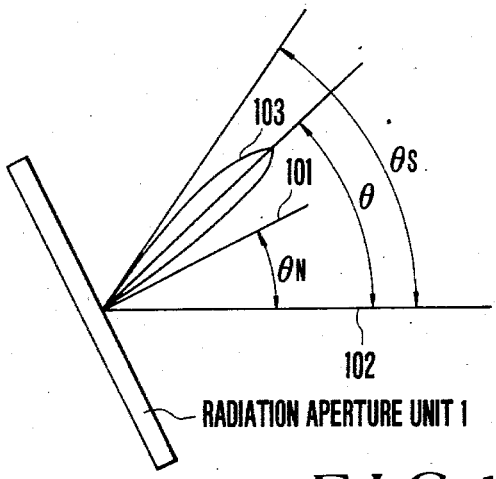
FIG. 1 PRIOR ART
FIG. 1 is a view illustrating, in a conceptual manner, one form of a prior art electronic scanning antenna.
Figure 2:
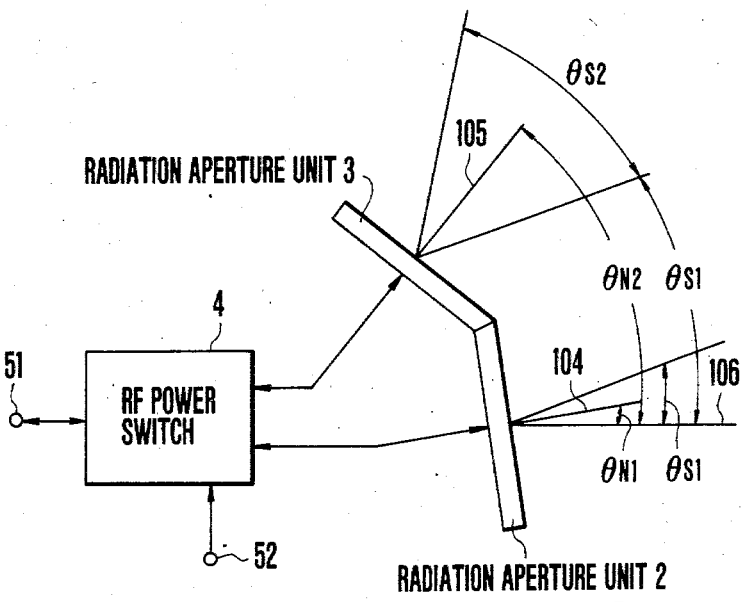
FIG. 2 PRIOR ART
FIG. 2 is a view illustrating in a conceptual manner, another form of a prior art electronic scanning antenna.
Figure 3:
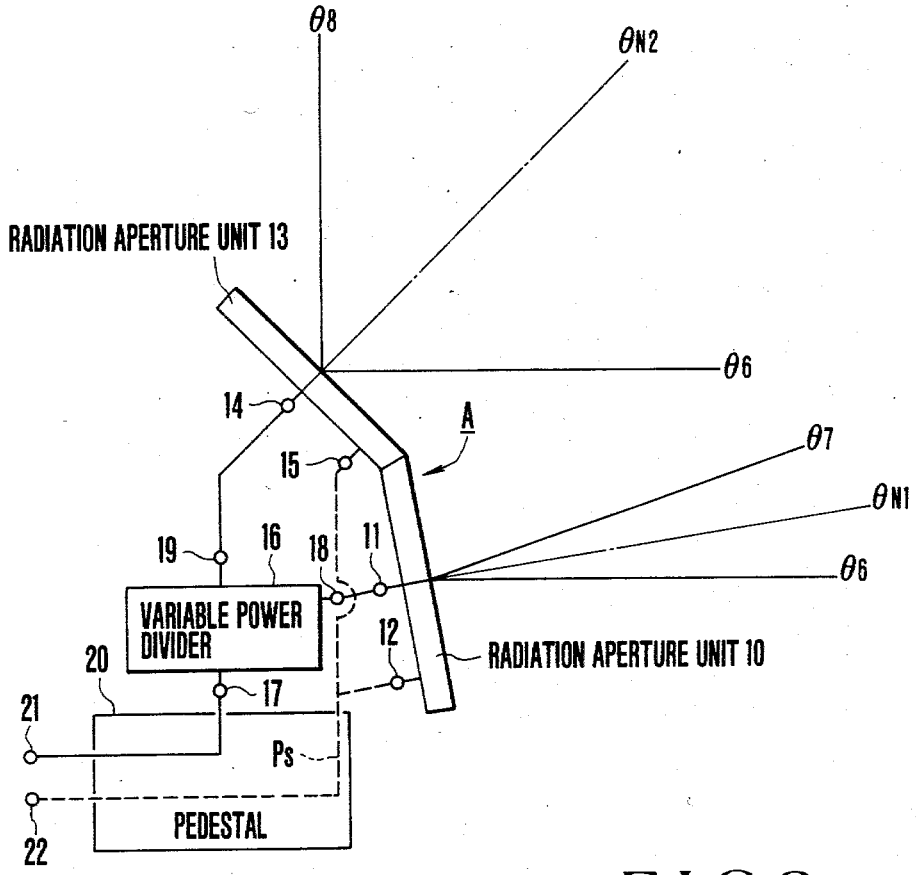
FIG. 3 is a view illustrating, in a conceptual manner, a first embodiment of an electronic scanning antenna according to the present invention.
Figure 4:
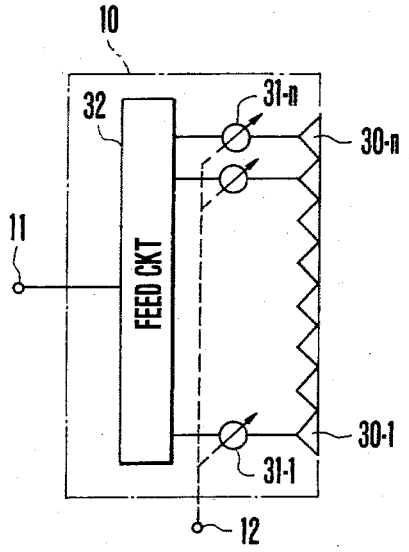
FIG. 4 is a view illustrating an internal configuration of an antenna radiation unit shown in FIG. 3.
Figure 5:
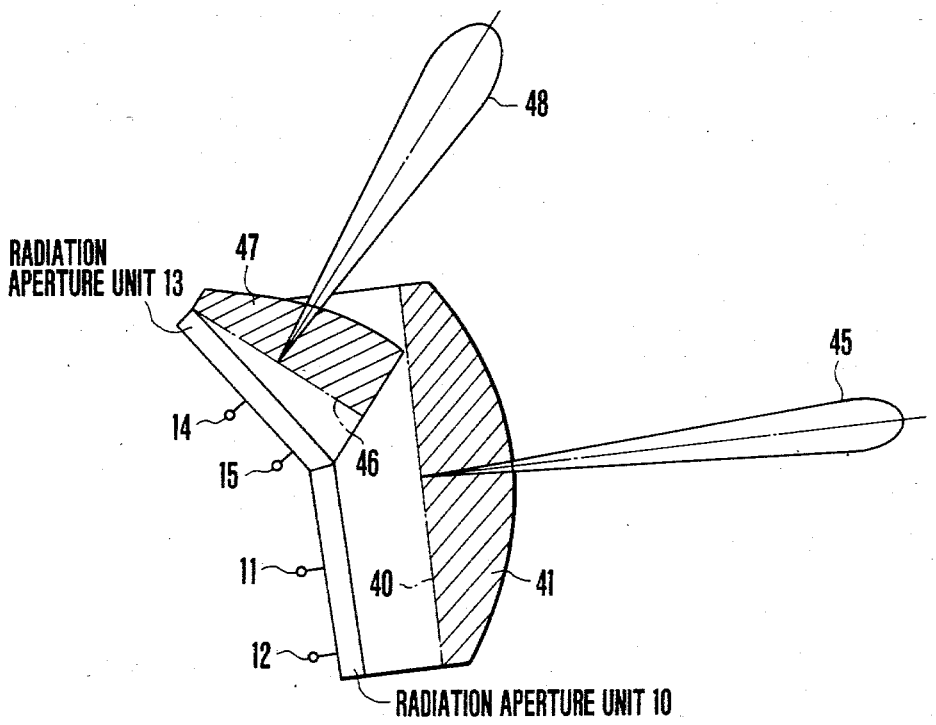
FIG. 5 is a view showing, in a conceptual manner, how a power distribution and a beam are formed on an equivalent aperture surface in connection with the antenna shown in FIG. 3.

A preferred first embodiment of the invention will be described with reference to FIGS. 3 to 5. As shown in FIG. 3, and electronic scanning antenna of the first embodiment of the invention comprises an antenna radiation section A comprised of radiation aperture units 10 and 13, a variable power divider 16 serving as a feed circuit for the antenna radiation section A, and a pedestal 20 for rotation of the antenna radiation section A and the variable power divider 16 in a horizontal plane. More particularly, the radiation aperture units 10 and 13 effect phase electronic scanning of beams in their elevation angle directions. The radiation aperture unit 10 is located so that an angle defined by the aperture normal is equal to an elevation angle of $\theta_{N1}$, thereby ensuring phase-scan of a beam in a relatively narrow range from an elevation angle $\theta_6$ to $\theta_7$ in accordance with a phase control signal $P_S$ inputted to a control terminal 12. On the other hand, the radiation aperture unit 13 is located so that an angle defined by the aperture normal is equal to an elevation angle of $\theta_{N2}$, thereby ensuring phase-scan of a beam in a relatively broad range from an elevation angle $\theta_6$ to $\theta_8$ in accordance with the phase control signal $P_S$ inputted to a control terminal 15. The variable power divider 16 distributes a signal from an input terminal 17 in a predetermined power ratio so as to deliver the distributed power to two output terminals 18 and 19 or deliver full power to the output terminal 19 in accordance with an external control signal (not shown). The pedestal 20 rotates the radiation aperture units 10 and 13 and the variable power divider 16 mounted on a rotating stage of the pedestal. Further, two antenna input terminals 21 and 22 are provided in association with the pedestal 20 wherein one input terminal 21 is for a high frequency signal and the other input terminal 22 is for the phase shift control signal $P_S$.

The operation of an electronic scanning antenna according to the first embodiment will be described. In general, when the operation of an antenna is explained, it is sufficient that either the operation at the time when an electric wave is transmitted or the operation at the time when received is referred to. The explanation below will be made at the time of transmission.

A high frequency signal inputted to the antenna input terminal 21 is supplied to the input terminal 17 of the variable power divider 16. The variable power divider 16 is responsive to the input signal so as to output an power output in accordance with a scanning elevation angle of an antenna beam under the control of an external control signal. Namely, when the scanning elevation angle is in a low elevation angle range, the output power is divided at a predetermined ratio and delivered to the output terminals 18 and 19, respectively, while when the scanning elevation angle is in a high elevation angle, the full power is delivered to the output terminal 19. The thus distributed output signal of the variable power divider 16 is supplied to the radiation aperture units 10 and 13 to create predetemined aperture surface electric field distributions under the control of a phase shift control signal, thereby forming radiation beams directed in predetermined elevation angles, respectively. The phase shift control signal $P_S$ supplied to the antenna input terminal 22 is sent to the respective control terminals 12 and 15 of the radiation aperture units 10 and 13 through the pedestal 20.

How the predetermined aperture distribution is created will now be described in detail. When it is desired to form the beam in a low elevation angle range from $\theta_6$ to $\theta_7$, the output signal of the variable power divider 16 is supplied at a predetermined power ratio to the input terminal 11 of the radiation aperture unit 10 and the input terminal 14 of the radiation aperture unit 13. In FIG. 4, showing an internal configuration of the radiation aperture unit 10, a signal supplied to the input terminal 11 is distributed into n outputs by a feed circuit 32 so as to provide a predetermined vertical aperture power distribution, and the n outputs thus distributed are supplied to radiating elements 30-1 to 30-n through n phase shifters 31-1 to 31-n connected in parallel with output terminals of the feed circuit 32, respectively. In this instance, setting of respective phase shifters 31-1 to 31-n is controlled by the above-mentioned phase shift control signal $P_s$. Further, a signal supplied to the input terminal 14 of the radiation aperture unit 13 is subjected to the same setting operation in respect of power and phase as that for the radiation aperture unit 10, thus realizing a predetermined surface electric field aperture distribution. As a result, power radiating toward space is the sum of the power radiations from the radiation aperture units 10 and 13, thus forming a resultant beam. With reference to FIG. 5, assuming that the radiation aperture units 10 and 13 are equivalently considered to be a single aperture, the feed circuits in the radiation aperture units 10 and 13 are made so that a power distribution 41 of an equivalent aperture 40 viewed from a predetermined elevation angle is equal to a power distribution based on a predetermined design. Further, the settings of the phase shifters are controlled in accordance with a beam scanning elevation angle under the control of a phase shift control signal supplied from the terminals 12 and 15 so that radiating electric waves from the respective radiating elements are in phase with each other at the equivalent aperture 40. As a result, within a low elevation angle range from $\theta_6$ to $\theta_7$, a narrow beam radiating from the equivalent aperture 40 having a large aperture surface is formed and scanned in a range where the degradation in radiation characteristics is small.

Then, when forming a beam in a high elevation angle range, the output signal of the variable power divider 16 is all delivered to the output terminal 19 and then is inputted to the radiation aperture unit 13 through the input terminal 14. In this instance, since the radiation aperture unit 10 does not contribute to electric wave radiation, a radiating beam is formed only by the radiation aperture unit 13. To form a radiating beam at a predetermined high elevation angle, when the phase-shift amounts of the phase shifters are set to predetermined values in accordance with the elevation angle under the control of a phase shift control signal from the input terminal 15, an equivalent aperture 46 is formed and a power distribution 47 becomes equal to a distribution determined by feed circuits. As a result, a beam 48 having a broad beam width is formed at a predetermined elevation angle within a high elevation angle range.

As stated above, the antenna of the first embodiment functions to form and scan a narrow beam by effectively making use of the overall aperture in a low elevation angle range in a vertical plane, and to form and scan a broad beam formed by part of the aperture in a high elevation angle range in a vertical plane. In most electromagnetic wave detection systems such as radars etc., it is required to provide, in a low elevation angle range, larger search distance, higher angular resolution and more sufficiently suppressed sidelobe characteristics than those for a high elevation angle range, and to provide, in a high elevation angle range, a beam of a broad width for the purpose of reducing elevation angle scanning time as necessary. Accordingly, the antenna of the first embodiment can be suitably applied to such electromagnetic wave detection systems. The antenna according to this embodiment, in spite of its relatively small size, can satisfy the above-mentioned requirements with a high efficiency because the aperture efficiency is larger than that of the prior art antenna, and when rotated mechanically in the horizontal plane, makes it possible to provide hemispherical spatial coverage from the horizontal direction to the zenithal direction.

As stated above, the electronic scanning antenna of the first embodiment according to the present invention is configured so that a plurality of scanning planes overlap with each other, thereby forming a beam using two or more radiation aperture units in a specified direction. Thus, this ensures the formation of a narrow beam by effectively making use of the antenna aperture, and the expansion of the overall beam scanning range.

In the foregoing embodiment, it has been described that the number of the radiation aperture units is two, but the present invention is applicable to other cases, for example, wherein the antenna radiation section is provided with N (larger than 2) radiation aperture units, or each of the N radiation aperture units constitutes a part of a continuously varying curved surface. Further, in the foregoing embodiment, it has been described that the radiation aperture unit 10 (or 13) is based on an electronic phase scanning system, but it may also be of a non-scanning fixed system with attainment of similar expansion of the overall beam scanning range including fixed beams each of which is directed to the beam direction of the corresponding non-scanning fixed aperture unit.

Further, in the above-mentioned embodiment, it has been described that the phase electronic scanning antenna is scanned in a single plane (in one-dimensional direction of angular variations) defined by an one-dimensional array of radiating elements. However, the present invention is not limited to the scanning in the single plane, but the phase scanning in two or more planes may be employed by using a beam switching system based on an expansion of the one-dimensional phased array of radiating elements (see Japanese Patent Application Laid-open Nos. 44106/84 and 47808/84) and U.S. Pat. application No. 06/529030.

Further, the present invention may be applied to an antenna radiation section using a two-dimensional phased array of radiating elements for spatial (three-dimensional) beam scanning.

Further, where coverage of 360 degrees in the horizontal plane is not required, the radiation aperture units and parts associated therewith may be fixed without providing them on a pedestal.

Moreover, it is not limited that the strip of a plurality of bent of radiation surfaces extends in the vertical direction, but the strip may be turned through 90° so as to extend in the horizontal direction, thus expanding the scanning range of a beam scanning antenna in the horizontal plane. Further, by forming a narrow beam in a specified direction in the horizontal plane, it is possible to enhance detection capability of a radar in the specified direction.

Figure 6:
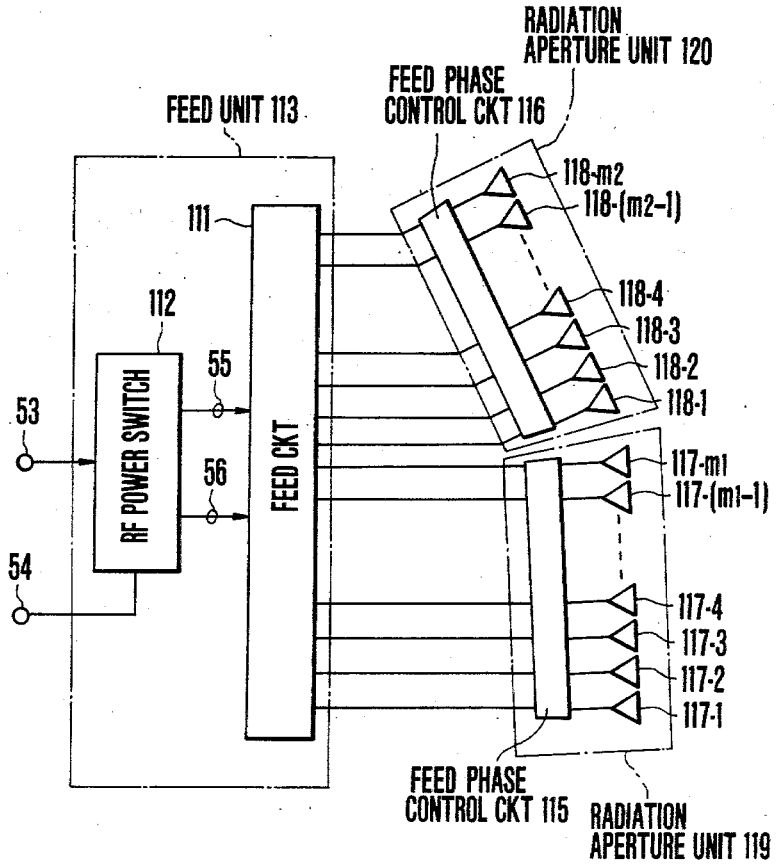
FIG. 6 is a block diagram illustrating a second embodiment of an electronic scanning antenna according to the present, invention.

Then, a second emboidment of the invention will be described with reference to FIGS. 6 to 9. As shown in FIG. 6, an electronic scanning antenna of this embodiment comprises a first radiation aperture unit 119 including a feed phase control circuit 115 and $m_1$ (positive integer) radiating elements 117-1 to 117-$m_1$, a second radiation aperture unit 120 including a feed phase control circuit 116 and $m_2$ (positive integer) radiating elements 118-1 to 118-$m_2$, and a feed unit 113 including a feed circuit 111 and a signal switching circuit 112.

The operation of the electronic scanning antenna according to this embodiment will be described. The explanation of the operation will be made at the time of transmission for the same reason as in the foregoing embodiment.

Figure 8:
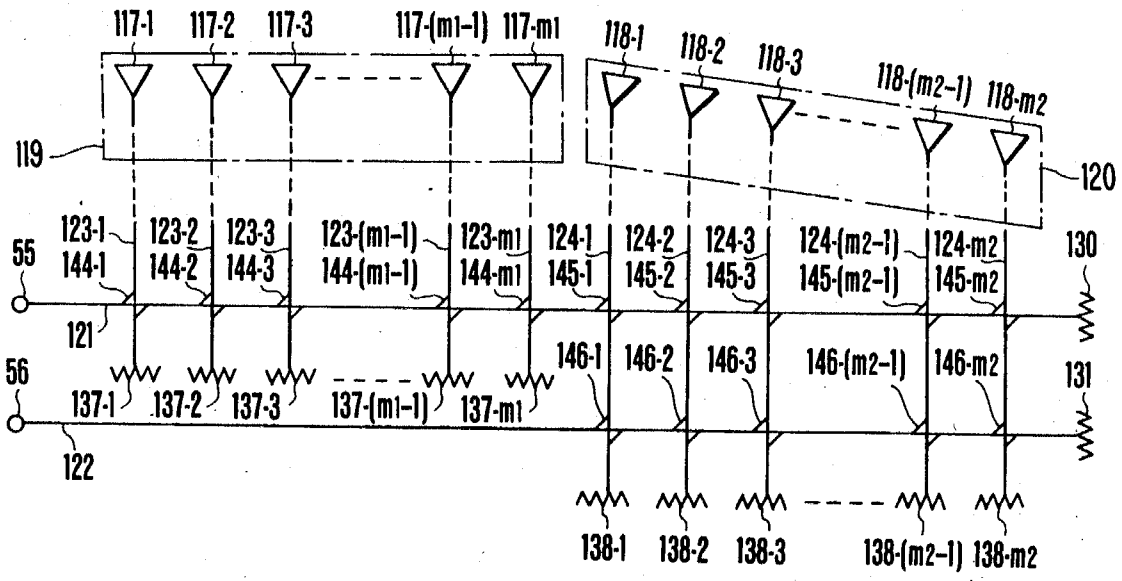
FIG. 8 is a circuit diagram schematically illustrating a feed circuit employed in the second embodiment of the present invention.

In FIG. 6, the first radiation aperture unit 119 is set so that the normal to the aperture plane makes an elevation angle $\theta_{N1}$ and the second radiation aperture unit 120 is set so that the normal to the aperture plane makes an elevation angle $\theta_{N2}$ (see FIG. 3). In this embodiment of the present invention, the major part of the feed circuit 111 in the feed unit 113 is shown in FIG. 8. A first series feedline 121 has one end serving as a beam port for input power and the other end terminated by a resistive termination 130. Similarly, the second series feedline 122 has one end serving as a beam port for input power and the other end terminated by a resistive termination 131. There are further provided a plurality of parallel feed lines 123-1 to 123-$m_1$ and 124-1 to 124-$m_2$. For instance, the parallel feedline 123-i has one end connected to a radiating element 117-i via a feed phase control circuit 115 (not shown) and the other end terminated by a resistive termination 137-i ($i=1, 2 \ldots$ or $m_1$). The parallel feedline 124-i has one end connected to a radiating element 118-i via a feed phase control circuit 116 (not shown) and the other end terminated by a resistive termination 138-i ($i=1, 2, \ldots$ or $m_2$).

The above-mentioned first series power feedline 121 intersects the parallel feedlines 123-1 to 123-$m_1$ provided at a particular interval related to the wavelength of a signal to thereby define a matrix configuration. A plurality of directional couplers 144-1 to 144-$m_1$ are located at the intersections of the matrix respectively. Further, the above-mentioned first series feedline 121 and the second series feedline 122 intersect the parallel feedlines 124-1 to 124-$m_2$ provided at a particular interval related to the signal wavelength, thereby defining a matrix configuration. A plurality of directional couplers 145-1 to 145-$m_2$ and 146-1 to 146-$m_2$ are located at the intersections of the matrix. Thus, a transmission signal propagating through the first series power feedline 121 is fed to radiating elements 117-1 to 117-$m_1$ and 118-1 to 118-$m_2$ through the directional couplers 144-1 to 144-$m_1$ and 145-1 to 145-$m_2$, respectively. Likewise, a transmission signal propagating through the second series power feedline 122 is fed to radiating elements 118-1 to 118-$m_2$ through the directional couplers 146-1 to 146-$m_2$, respectively. In FIG. 8, resistive terminations as non-reflective terminations 137-1 to 137-$m_1$, 138-1 to 138-$m_2$, 130 and 131 are provided for preventing adverse effects of interference due to reflective signals on the transmission lines (power feedlines) upon the radiation characteristics. To describe the operation of the feed unit 113, the signal feed mode for the radiation aperture units 119 and 120 is classified into three types.

The first signal feed mode is that a signal from the terminal 53 is switched by the RF power switch 112 under the control of a radiation beam control signal from the terminal 54, so that the signal power is inputted to the terminal 55 of the feed circuit 111. In this instance, the coupling degree distribution of the directional couplers 144-1 to 144-$m_1$ and 145-1 to 145-$m_2$ with respect to the transmission line 121 is set in advance so that an electric field distribution at the aperture units 119 and 120 becomes a predetermined electric field distribution. Thus, this creates an electric field distribution 108 at the plane of the aperture shown in FIG. 7*b* to which both radiation aperture units 119 and 120 constituting the antenna radiation section effectively contribute. As a result, a predetermined radiation beam scanning is carried out with respect to the power feed phase control circuits 115 and 116 provided in the radiation apertures 119 and 120, respectively, under the control of a radiation beam control signal externally supplied.

The second signal feed mode is that a signal from the terminal 53 is distributed, in the signal switching circuit 112, to the terminals 55 and 56 under the control of a radiation beam control signal from the terminal 54. In this instance, the coupling degree distribution of the directional couplers 144-1 to 144-$m_1$ and 145-1 to 145-$m_2$ with respect to the transmission line 121 and the coupling degree distribution of the directional couplers 146-1 to 146-$m_2$ with respect to the transmission line 122 are set in advance so that an electric field distribution at the aperture plane becomes a predetermined electric field distribution 108 at the aperture plane shown in FIG. 7*b* to which both radiation apertures 119 and 120 constituting the antenna radiation section effectively contribute.

Figure 7A:
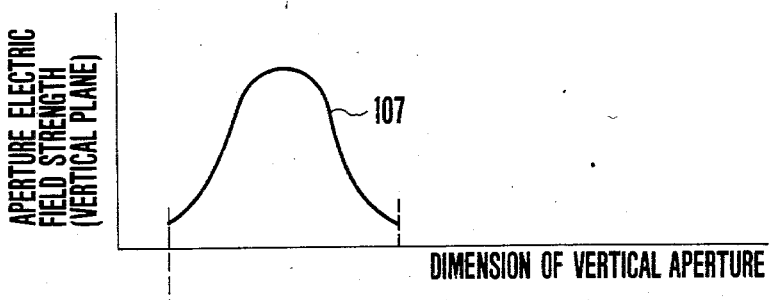
FIGS. 7*a* and 7*b* show characteristic curves showing aperture surface electric field distributions, respectively, in the second embodiment of the invention.

The third signal feed mode is that a signal from the terminal 53 is switched by the RF power switch 112 under the control of a radiation beam control signal from the terminal 54, so that full signal power obtained by this switching is supplied to the terminal 56. In this instance, the coupling degree distribution of the directional couplers 146-1 to 146-m$_2$ shown in FIG. 8 with respect to the transmission line 122 is set so that an electric field distribution at the aperture plane at the radiation aperture 120 becomes a predetermined electric distribution. Thus, this creates an electric field distribution 107 at the aperture plane as shown in FIG. 7*a* with the antenna radiation section being formed only by the radiation aperture 120. A predetermined radiation beam scanning is carried out by the feed phase control circuit 116 provided for the radiation aperture unit 120 under the control of a radiation beam scanning control signal externaly supplied.

The signal feed mode in the feed unit has been described using an example of a feed circuit shown in FIG. 8. However, the signal feed mode is not limited to the above-mentioned mode. Namely, in general, there may be available other various kinds of signal feed modes depending on the circuit configuration of the RF power switch 112. Further, in the above-mentioned embodiment, the operation thereof has been described in relation to the radiation characteristics in a vertical plane with reference to FIG. 6, and any radiating elements contributing to the radiation characteristics in the horizontal plane have been omitted in the radiation apertures 119 and 120 shown in FIG. 6. However, even if the operation of the electronic scanning characteristics in a vertical plane is made on the premise of such an omission, there is not any possibility that the generality in describing the operation of the invention is lost.

Figure 9:
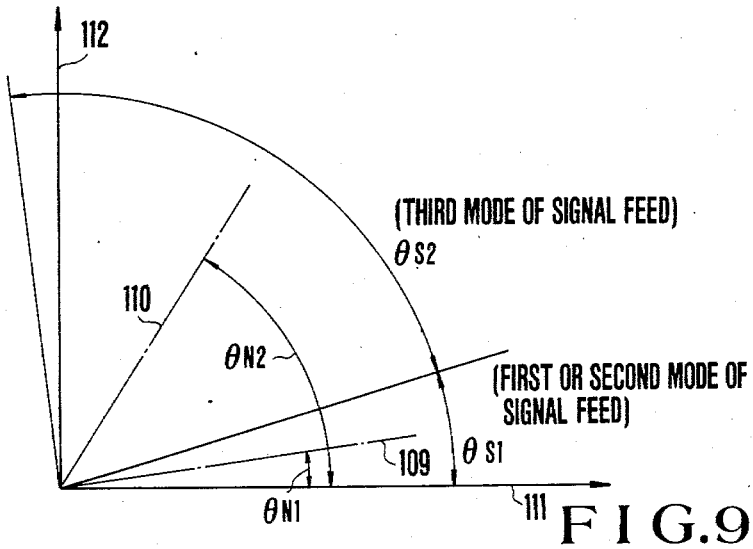
FIG. 9 is an explanatory view showing an example of a beam scanning range in a vertical plane in the second embodiment of the invention.

In the electronic scanning antenna of the invention shown in FIG. 6, for instance, a radiating beam scanning in the vertical plane as shown in FIG. 9 can be realized so as to correspond to the three signal feed modes. In FIG. 9, where the target scan area lies within a range of small elevation angle, the beam scanning is carried out over an angular range of from 0 to $\theta_{s1}$, while where the target scan area lies within a range of large elevation angle, the beam scanning is carried out over an angular range of from $\theta_{s1}$ to $(\theta_{s1}+\theta_{s2})$. In this instance, the angular range $\theta_{s1}$ for scanning the radiation beam corresponds to the above-mentioned first and second signal feed modes, and the angular range $\theta_{s2}$ for scanning the radiation beam corresponds to the above-mentioned third signal feed mode. As previously described, when the signal feed is effected in the first and second signal feed modes, both the first radiation aperture unit 119 and second radiation aperture unit 120 shown in FIG. 6 contribute to the formation of radiation beam. Accordingly, the antenna functions related to the detection capability of a radar system can be effectively realized in a range of a small elevation angle, thus providing an electronic scanning antenna having high aperture efficiency and excellent radiation characteristics. As previously described, this is attributed to the fact that power feed is carried out in such a manner that the preferably designed aperture plane electric field distribution as shown in FIG. 7 can be established at at least one radiation aperture unit. It is to be noted that, when a radiating beam is scanned in a range of a small elevational angle, whether the first signal feed mode is selected or the second signal feed mode is selected belongs to the specification when designing prior to its exercise. Actually, there is a possibility that either of two modes can be employed.

Turning to the third signal feed mode, only the second aperture unit 120 contributes to the formation of the radiation beam. The scanning angular range for a radiating beam in this case corresponds to the angular range from $\theta_{s1}$ to $(\theta_{s1}+\theta_{s2})$ shown in FIG. 9. From a viewpoint of detection capability of a radar system, the detection distance is shortened in a range of large elevational angle and therefore, only the second aperture unit 120 suffices in forming a radiating beam. It is rather more important to increase a scanning elevation angle with the radiation characteristics being normally maintained. Since the preferably designed electric field distribution is formed as shown in FIG. 7*a* by the second radiating aperture unit 120, it is apparent that the above-mentioned radiation characteristics can be normally maintained over a range of scanning angle. It is needless to say that a suitable radiation beam for scanning may be formed utilizing a plurality of radiation apertures in a range of a large elevational angle as necessary.

As described above, according to the second embodiment, by setting the electric field distribution on the radiation aperture plane formed by at least one radiation aperture unit such that it corresponds to a predetermined design electric field distribution, the aperture efficiency and radiation characteristic of the radiation beam can be kept normal constantly over the predetermined scanning angle range.

A preferred third embodiment according to the present invention will be described with reference to FIGS. 10 to 14.

Figure 10:
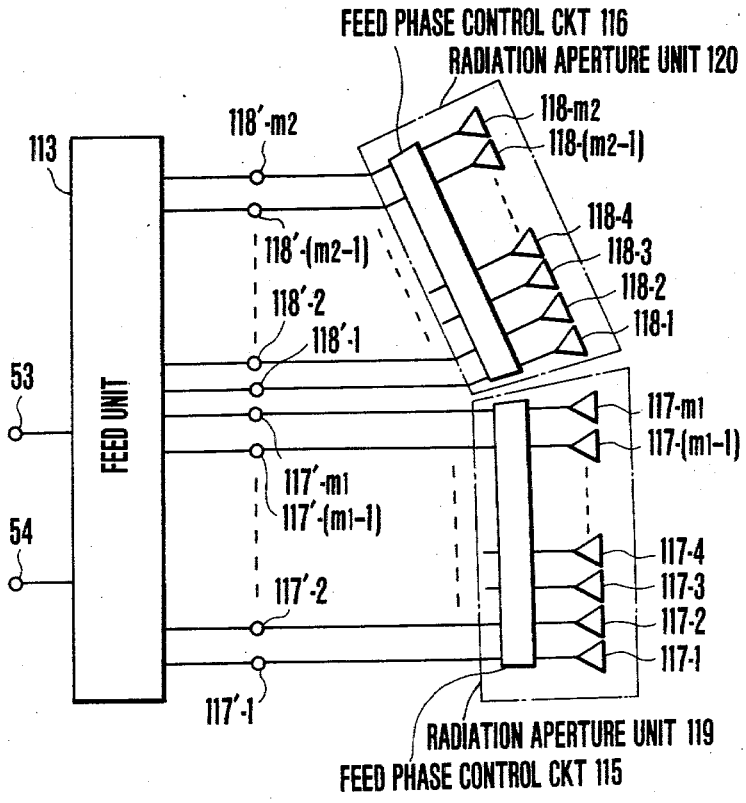
FIG. 10 is a view illustrating a third embodiment of an electronic scanning antenna according to the present invention.

FIG. 10 shows a block diagram illustrating the third embodiment of the invention having a similar configuration to that of the second embodiment shown in FIG. 6, and the same parts identical to those in FIG. 6 are designated by the same reference numerals, respectively, and therefore, their explanation will be omitted, wherein reference numerals 117'-1 to 117'-m$_1$ and 118'-1 to 118'-m$_2$ denote output terminals, respectively.

Figure 11:
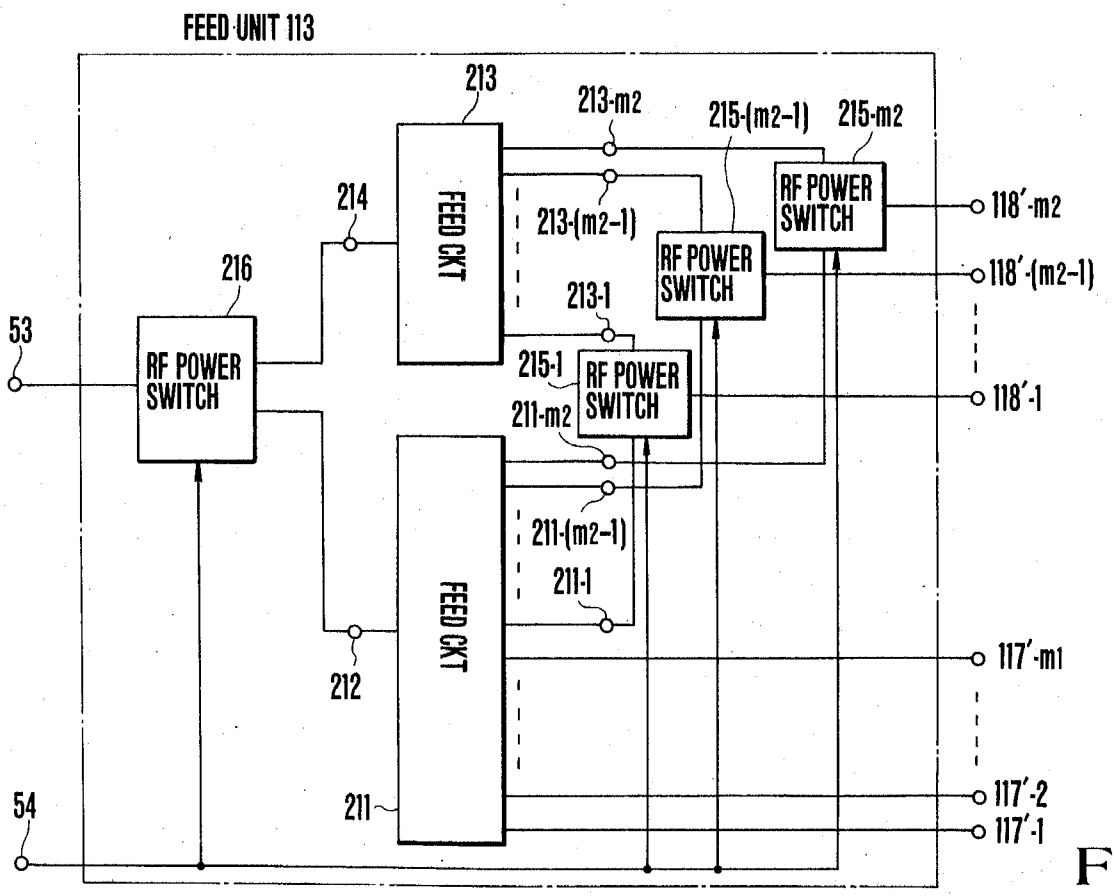
FIG. 11 is a block diagram illustrating an internal configuration of a feed unit shown in FIG. 10.

FIG. 11 is a block diagram illustrating a first example related to power feed unit 113. The feed unit 113 comprises an RF power switch 216 having the input terminal 53, a feed circuit 211 having an input terminal 212 and output terminals 117'-1 to 117'-m$_1$ and 211-1 to 211-m$_2$, and m$_2$ RF power switches 215-1 to 215-m$_2$ connected to the pair of corresponding output terminals 211-i and 213-i (i=1 to m$_2$) of the feed circuits 211 and 213 and having output terminals 118'-i (i=1 to m$_2$).

The operation of the electronic scanning antenna according to this embodiment will be described. The explanation of the operation will be made at the time of transmission for the same reason for the foregoing embodiments. In FIG. 10, normals of the aperture units 119 and 120 make elevation angles $\theta_{N1}$ and $\theta_{N2}$ as in the foregoing embodiment shown in FIG. 6.

In FIG. 11, high frequency power applied to the input terminal 53 of the feed unit 113 is fed to the RF power switch 216. The RF power switch 216 switches the input high frequency power under the control of a radiation beam control signal input from the input terminal 54, thereby to supply the output power to either the feed circuit 211 or the feed circuit 213. Reference numerals 212 and 214 denote input terminals, respectively. The feed circuit 211 has m$_1$ output terminals 117'-1 to 117'-m$_1$ and m$_2$ output terminals 211-1 to 211-m$_2$ and the feed circuit 213 has also m$_2$ output terminals 213-1 to 213-m$_2$. There are RF m$_2$ power switches 215-1 to 215-$m_2$ having respective output terminals 118'-1 to 118'-$m_2$. When an attention is drawn to an RF power switch 215-i (i=1 to $m_2$) as a representative, the RF power switch 215-i has two inputs connected to the corresponding output terminals 211-i and 213-i (i=1 to $m_2$). Thus, power from either the feed circuit 211 or 213 is selected in accordance with the same radiation beam control signal as that for the RF power switch 216. The power thus selected is outputted to one of the output terminals. When the feed circuit 211 is selected, the output power is delivered directly to the output terminals 117'-1 to 117'-$m_1$ and to the output terminals 118'-1 to 118'-$m_2$ passing through the RF power switches 215-1 to 215-$m_2$. In relation to the operation of the feed unit 113, the signal power feed mode at the relation apertures 119 and 120 is classified into two types.

Figure 7B:
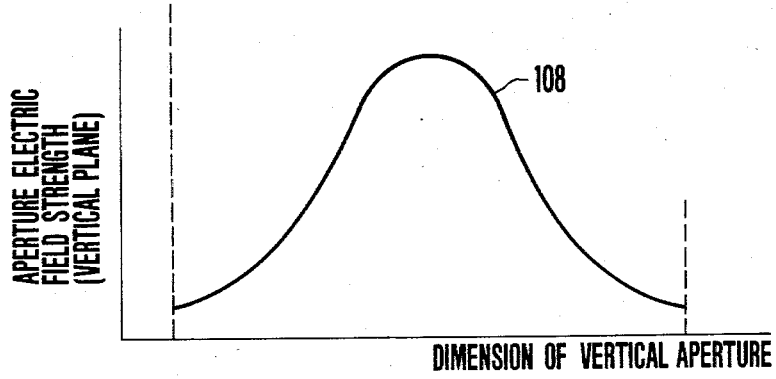

The first signal power feed mode is that a signal from the terminal 53 is switched in the RF power switch 216 under the control of a radiation beam control signal from the terminal 54 so that a power signal is fed to the input terminal 212 of the feed circuit 211. In this instance, the distribution in the power feed circuit 211 is set in advance so that the aperture plane electric field distribution at the radiation apertures 119 and 120 becomes a predetermined electric field distribution. Thus, this creates an aperture plane electric field distribution 108 as shown in FIG. 7*b* with both the radiation aperture units 119 and 120 constituting an antenna radiation section effectively contributing to the creation of the electric field distribution. As a result, a predetermined radiation beam is formed and scanned by the power feed phase control circuits 115 and 116 provided in the radiation aperture units 119 and 120, respectively, under the control of a radiation beam control signal.

The second signal power feed mode is that a signal from the terminal 53 is switched in the RF power switch 216 under the control of a radiation beam control signal from the terminal 54 so that full signal power is fed to the input terminal 214 of the power feed circuit 213. In this instance, a power distribution of the feed circuit 213 is set in advance so that an aperture plane electric field at the radiation apertures 120 becomes a predetermined electric field distribution. Thus, this creates an aperture plane electric field distribution 107 as shown in FIG. 7*a* with the antenna radiation section being formed only by the radiation aperture unit 120. As a result, a predetermined radiation beam is formed and scanned by the feed phase control circuit 116 provided in the radiation aperture unit 120 under the control of a radiation beam control signal externally supplied.

In the above-mentioned embodiment, the operation of the present invention has been described in relation to the radiation characteristics in the vertical plane with reference to FIG. 10, and any radiating element contributing to the radiation characteristics in a horizontal plane in the radiation apertures 119 and 120 shown FIG. 10 has been omitted. However, even if the operation of the electronic scanning characteristics in the vertical plane is made on the premise of such an omission, there is not any possibility that the generality in describing the operation of the invention is lost.

Figure 12:
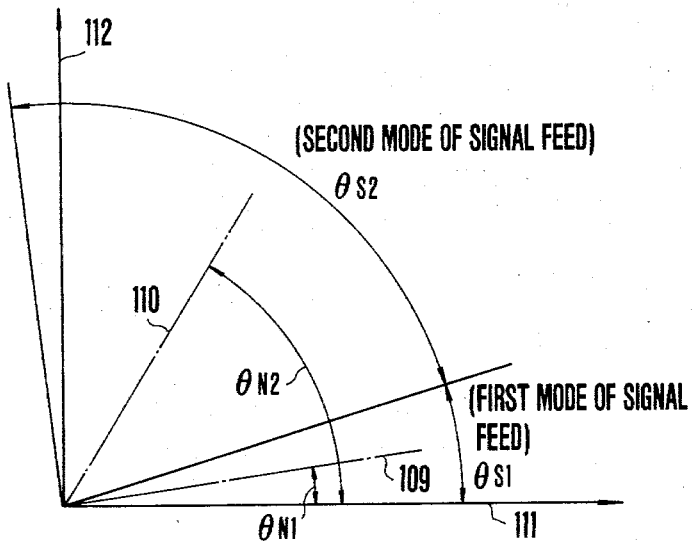
FIG. 12 is an explanatory view showing an example of a beam scanning range in a vertical plane in the third embodiment, of the present invention.

In the electronic scanning antenna of the invention shown in FIG. 10, for instance, a radiating beam scanning in the vertical plane as shown in FIG. 12 can be realized so as to correspond to the two signal feed modes. In FIG. 12, where the target scanning area lies within a range of small elevation angles, the beam scanning is carried out over an angular range from 0 to $\theta_{s1}$ of the elevation angle, while where the target scan area lies within a range of large elevation angles, the beam scanning is carried out over an angular range from $\theta_{s1}$ to $(\theta_{s1}+\theta_{s2})$. In this instance, the angular range $\theta_{s1}$ for scanning the radiation beam corresponds to the above-mentioned first signal feed mode, and the angular range $\theta_{s2}$ for scanning the radiation beam corresponds to the above-mentioned second signal feed mode. As previously described, when the signal feed is effected in the first signal power feed mode, both the first radiation aperture unit 119 and second radiation aperture unit 120 shown in FIG. 10 contribute to the formation of radiation beam. Accordingly, the antenna functions related to the detection capability of a radar system can be effectively realized in a range of a small elevation angle, thus providing an electronic scanning antenna having high aperture efficiency and excellent radiation characteristics. As previously described, this is attributed to the fact that power feed is carried out in a manner to create an aperture plane electric field distribution, preferable in design, as shown in FIG. 7*b* with respect to at least one radiation aperture unit which can be utilized.

Turning to the second signal feed mode, only the second aperture unit 120 contributes to the formation of the radiation beam. The scanning angular range for a radiating beam in this case corresponds to the angular range from $\theta_{s1}$ to $(\theta_{s1}+\theta_{s2})$ shown in FIG. 12. From a view point of detection capability of a radar system, the detection distance is shortened in a range of large elevational angle, and therefore there is not produced any inconvenience in forming a radiating beam only utilizing the second radiating aperture unit 120. It is rather more important to increase a scanning elevation angle with the radiation characteristics being normally maintained. Since the electric field distribution in respect to the aperture preferable in design as shown in FIG. 7*a* is formed by the second radiating aperture unit 120, it is apparent that the above-mentioned radiation characteristics can be normally maintained over a range of the scanning angle. It is needless to say that a suitable radiation beam for scanning may be formed utilizing a plurality of radiation apertures in a range of as large an elevational angle as necessary.

A modification of the present embodiment will be described with reference to FIGS. 13 and 14.

Figure 13:
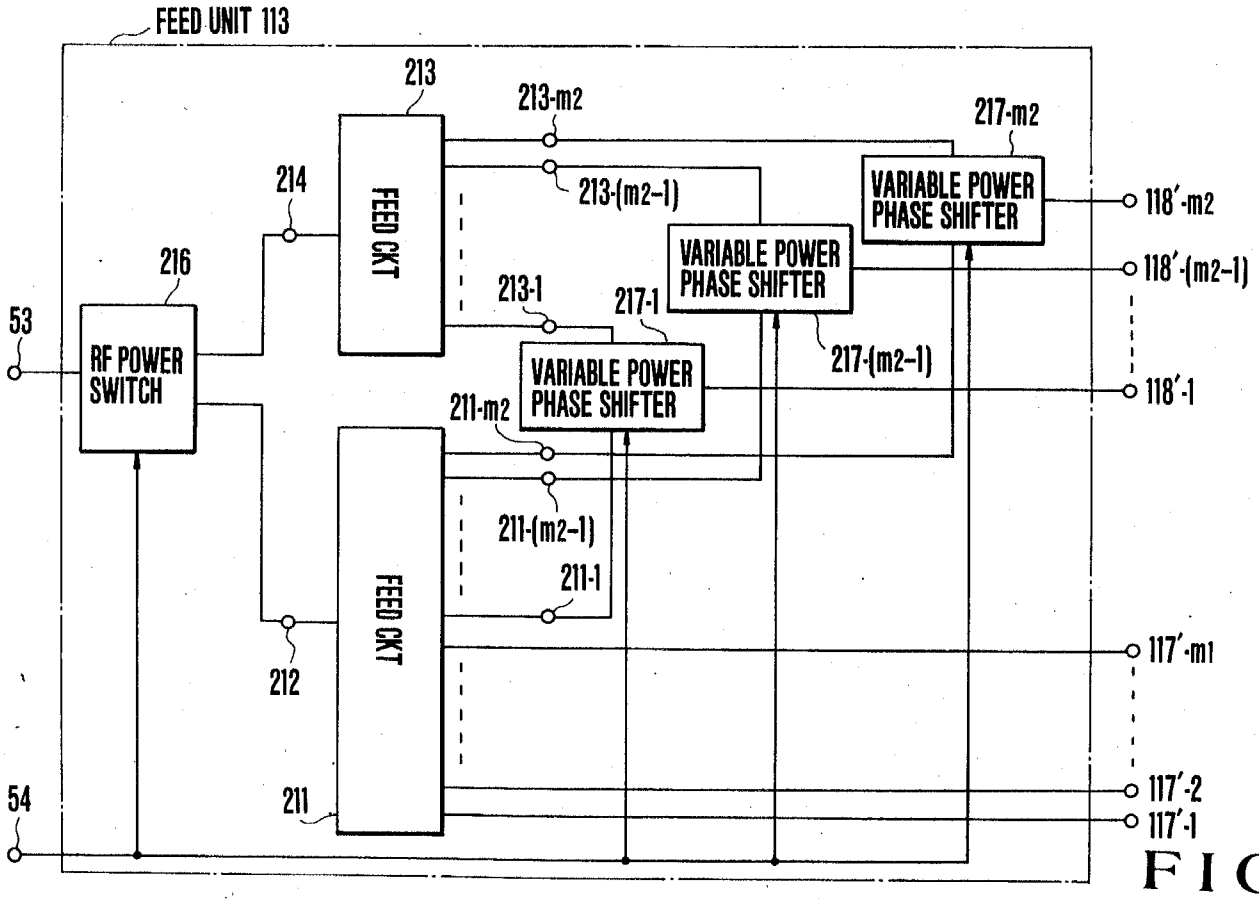
FIG. 13 is a block diagram illustarating a modification of the feed unit shown in FIG. 11.

FIG. 13 is a block diagram illustrating another example of the feed unit 113, wherein the configuration shown in FIG. 13 is similar to that shown in FIG. 11 and only differs therefrom in that variable power phase shifters 217-1 to 217-$m_2$ are employed in place of the RF power switches 215-1 to 215-$m_2$ shown in FIG. 11.

Figure 14:
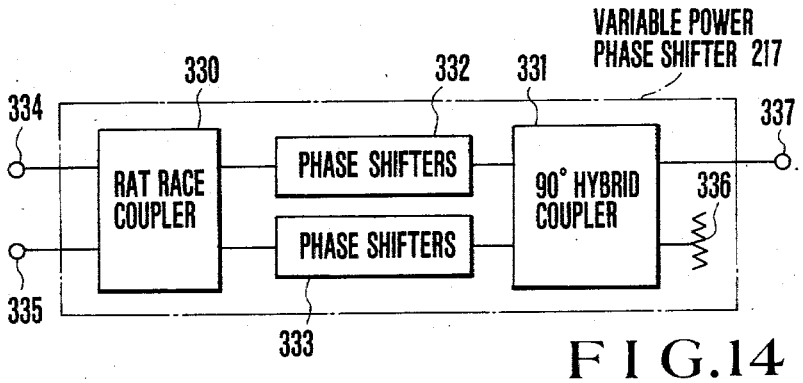
FIG. 14 is a block diagram illustrating an internal configuration of a variable power phase shifter shown in FIG. 13.

FIG. 14 shows an example of a two-input, one output type variable power phase shifter 217. The variable power phase shifter comprises two input terminals 334 and 335 for input power, a rat race coupler 330 whose inputs are respectively connected to the input terminals 334 and 335, electronically controlled phase shifters 332 and 333 connected in parallel with the output of the rat race coupler 330, and a 90 degrees hybrid coupler 331 connected to the respective outputs of the elctronically controlled phase shifters 332 and 333 wherein one output thereof is connected to an output terminal 337 and the other output is terminated by a resistive termination 336.

In operation, when power having a voltage $E_1$ and power having a voltage $E_2$ are supplied to the input terminals 334 and 335 of the variable power phase shifter 217, respectively, the input power is equally distributed to the two phase shifters 332 and 333 via the rat race coupler 330. The 90 degrees hybrid coupler 331 provides a resultant output of the distributed power from the phase shifters 332 and 333. Thus, the 90 degrees hybrid coupler 331 produces the resultant output on the output terminal 337 with respect to a matching load coupled thereto. Namely, the resultant output as represented by a voltage $E_A$ is obtained with respect to the input power having the voltage $E_1$ to the input terminal 334, and the input power having the voltage $E_2$ to the input terminal 335. In this instance, the output voltages $E_A$ is expressed by following equation:

$$E_A = E_1 \cos\left(\frac{\phi_2 - \phi_1}{2} + \frac{\pi}{4}\right) e^{-j\left(\frac{\phi 1+\phi 2}{2} + \frac{\pi}{4}\right)} - E_2 \sin\left(\frac{\phi_2 - \phi_1}{2} + \frac{\pi}{\phi}\right) e^{-j\left(\frac{\phi 1+\phi 2}{2} + \frac{\pi}{\phi}\right)}$$

$$E_B = E_1 \sin\left(\frac{\phi_2 - \phi_1}{2} + \frac{\pi}{4}\right) e^{-j\left(\frac{\phi 1+\phi 2}{2} + \frac{\pi}{4}\right)} + E_2 \cos\left(\frac{\phi_2 - \phi_1}{2} + \frac{\pi}{\phi}\right) e^{-j\left(\frac{\phi 1+\phi 2}{2} + \frac{\pi}{\phi}\right)}$$

where $\phi_1$ and $\phi_2$ denote delay phases given by the phase shifters 332 and 333, respectively.

Accordingly, the output power appearing on the output terminal 337 is determined by a ratio of the input power to the input terminal 334 to the input power to the input terminal 335 only depending upon the difference $(\phi_2-\phi_1)$ between setting, phases, and the phase of the output voltage $E_A$ is determined only by the sum $(\phi_1+\phi_2)$ of the setting phases, respectively. If the setting of the phase difference is such that $\Delta\phi$ $(=\phi_2-\phi_1)$ is equal to $-\pi/2$, then the full input power to the input terminal 334 will be delivered to the output terminal 337. Further, if the setting of the phase difference $\Delta\phi$ is such that $\Delta\phi$ is equal to $\pi/2$, then the full input power to the input terminal 335 will be delivered to the output terminal 337. On the other hand, the phase summation expressed as $\Sigma\phi=\phi_1+\phi_2$ can be set independent of the above-mentioned phase difference.

Accordingly, when the variable power phase shifter having a power switch function and a phase shift function is used instead of an RF power switch in the above-mentioned example, the function equivalent to the feed phase control circuit can be realized by $m_2$ vairable power phase shifters 217-1 to 217-m₂, without necessity of providing the feed phase control circuit 216 in the second radiation aperture 119 shown in FIG. 10. In this modified embodiment, if the setting phase summation expressed as $\Sigma\phi=\phi_1+\phi_2$ is set to a value corresponding to a desired beam elevation angle $\phi$ on the basis of the principle of phased array, then the phase shift quantities of the phase shifter provided in each variable power phase shifter 217-1 to 217-m₂ will be determined as $\phi_1=(\Sigma\phi-\Delta\phi)/2$ and $\phi_2=(\Sigma\phi+\Delta\phi)/2$.

The aperture distribution and the operation etc. of the radiation apertures 119 and 120 in forming and scanning a radiation beam is substantially identical to those in the first example. This modified embodiment is characterized in that the optimum aperture distribution is set due to the contribution of both the apertures 119 and 120 in a range of low elevation angle, thus realizing an electronic scanning antenna having a high aperture efficiency and excellent radiation characteristics, and in that a suitable aperture distribution is set only by the radiation aperture 120, thereby forming a beam having an enlarged beam width, thus allowing the scanning elevation angle to be increased. Further, in this modified embodiment, the employment of the variable power phase shifter eliminates the necessity of the phase shifter provided in the feed phase control circuit 216, thereby decreasing the number of parts for an antenna, resulting in a simplified antenna structure.

In the above description, the number of beams to be formed in a vertical plane has not been referred to. The number of beams concurrently formed is not limited to one. For instnace, if input terminals, RF power switches and feed circuits are designed in number so as to be in conformity with the number of beams, the present invention is applicable to an antenna in which a plurality of beams are concurrently formed or a multi-beam is formed. Further, in the above description, the number of antenna elements at the radiation aperture was equal to the number of input terminals leading through the feed phase control circuit. However, the present invention is not necessarily limited to the case the former is equal to the latter in number.

According to the third embodiment, like the second embodiment, by setting the electric field distribution on the radiation aperture plane formed by at least one radiation aperture unit such that it corresponds to a predetermined design electric field distribution, the aperture efficiency and radiation characteristic of the radiation beam can be kept normal constantly over the predetermined scanning angle range.

What is claimed is:

1. An electronic scanning antenna for scanning a radiation beam based on a phase electronic scanning within a predetermined beam scanning angular region, comprising:

( an antenna radiation section having N (integer more than one) radiation aperture units which totally form a predetermined radiation aperture of said electronic scanning antenna, said N radiation aperture units consisting of $N_1$ (zero or positive integer) radiation aperture units having a function to scan a radiation beam on the basis of a phase electronic scanning and $N_2$ $(=N-N_1$, zero or positive integer) radiation aperture units without the function of radiation beam scanning, said $N_1$ radiation aperture units and said $N_2$ radiation aperture units having beam forming angular regions constituting at least part of the predetermined beam scanning angular region, respectively; and means for simultaneously exciting at least two radiation aperture units to form a radiation beam in at least one direction on a predetermined beam scanning plane and for exciting a single radiation aperture unit or a combination of radiation aperture units which are different from said at least two radiation aperture units in at least one additional direction which is different from said at least one direction.

2. An electronic scanning antenna according to claim 1, wherein said antenna radiation section is rotated in a horizontal plane.

3. An electronic scanning antenna according to claim 1, wherein said predetermined beam scanning angular region is formed in a vertical plane.

4. An electronic scanning antenna according to claim 1, wherein said predetermined beam scanning angular region corresponds to a particular two-dimensional plane.

5. An electronic scanning antenna according to claim 1, wherein said predetermined beam scanning angular region corresponds to a particular three-dimensional space.

6. An electronic scanning antenna according to claim 1, wherein there is provided a one-input, N-output variable power divider having N output terminals connected to input terminals of said N radiation aperture units, respectively, and said variable power divider is switched in accordance with the beam direction in said predetermined beam scanning angular region so that its output is all delivered to a predetermined one of said N output terminals, or its output is delivered at a predetermined power ratio to at least two output terminals, thereby exciting a predetermined one or more radiation aperture units to form a radiation beam.

7. An electronic scanning antenna according to claim 1 further comprising a feed unit for setting an aperture electric field distribution at at least one radiation aperture unit of said antenna radiation section in conformity with a predetermined electric field distribution according to a predetermined beam scanning.

8. An electronic scanning antenna according to claim 7, wherein said feed unit has an RF power switching means for providing the predetermined electric field distribution.

9. An electronic scanning antenna according to claim 1 further comprising a feed unit including a plurality of feed circuits for setting predetermined aperture electric field distributions with respect to a plurality of radiation apertures of at least one radiation aperture unit constituting said antenna radiation section, an RF power switch having output terminals connected to input terminals of said plurality of feed circuits, and second RF power switches connected between output terminals of said plurality of feed circuits and inputs terminals of said antenna radiation section.

10. An electronic scanning antenna according to claim 1 further comprising a feed unit including a plurality of feed circuits for setting predetermined aperture electric field distributions with respect to a plurality of radiation apertures of at least one radiation aperture unit constituting said antenna radiation section, an RF power switch having output terminals connected to input terminals of said plurality of feed circuits, and variable power phase shifters connected between output terminals of said plurality of feed circuits and inputs terminals of said antenna radiation section.

* * * * *